US009725217B2

(12) United States Patent
Lee et al.

(10) Patent No.: US 9,725,217 B2
(45) Date of Patent: Aug. 8, 2017

(54) SPUIT-TYPE CONTAINER CAP FOR AUTOMATIC FILLING AND FIXED-AMOUNT DISPENSING

(71) Applicants: Young Joo Lee, Anyang-si (KR); Jae Kwang Hwang, Seoul (KR)

(72) Inventors: Young Joo Lee, Anyang-si (KR); Jae Kwang Hwang, Seoul (KR)

( * ) Notice: Subject to any disclaimer, the term of this patent is extended or adjusted under 35 U.S.C. 154(b) by 241 days.

(21) Appl. No.: 14/426,641

(22) PCT Filed: Jun. 7, 2013

(86) PCT No.: PCT/KR2013/005008

§ 371 (c)(1),
(2) Date: Mar. 6, 2015

(87) PCT Pub. No.: WO2014/042338

PCT Pub. Date: Mar. 20, 2014

(65) Prior Publication Data

US 2015/0232240 A1 Aug. 20, 2015

(30) Foreign Application Priority Data

Sep. 17, 2012 (KR) ..... 10-2012-0102571

(51) Int. Cl.

| | |
|---|---|
| ***B65B 1/04*** | (2006.01) |
| ***B65D 47/06*** | (2006.01) |
| ***B65D 43/02*** | (2006.01) |
| ***B65D 51/16*** | (2006.01) |
| ***B65D 53/00*** | (2006.01) |

(52) U.S. Cl.
CPC ..... *B65D 47/06* (2013.01); *B65D 43/0225* (2013.01); *B65D 51/16* (2013.01); *B65D 53/00* (2013.01)

(58) Field of Classification Search
CPC ..... B65D 7/18; B65D 7/06; G01F 11/028
USPC ..... 141/22, 23
See application file for complete search history.

(56) References Cited

U.S. PATENT DOCUMENTS 9,221,048 B2 * 12/2015 Duquet ..... A45D 34/04

FOREIGN PATENT DOCUMENTS

| | | |
|---|---|---|
| JP | 07-017757 U | 3/1995 |
| KR | 20-0453126 Y1 | 4/2011 |
| KR | 10-1152159 B1 | 6/2012 |
| KR | 10-1162644 B1 | 7/2012 |

* cited by examiner

*Primary Examiner* — Jason K Niesz
(74) *Attorney, Agent, or Firm* — East West Law Group; Heedong Chae

(57) ABSTRACT

This invention relates to a spuit-type container cap for automatic filling and fixed-amount dispensing, which has an improved structure of sucking and dispensing cosmetics accommodated in a spuit-type cosmetics container into the inside of a spuit pipe when the cosmetics are extracted in a spuit manner, so that a user can manipulate the spuit-type cosmetics container simply and conveniently. Thus, the present invention enables: the content accommodated in the container to be suck into the inside of the spuit pipe when the container cap including the spuit is released from the screw-coupled state with the container, and a fixed amount of the cosmetic content to be dispensed one drop by one drop when the upwardly protruded rubber button is pressed.

4 Claims, 5 Drawing Sheets

SPUIT-TYPE CONTAINER CAP FOR AUTOMATIC FILLING AND FIXED-AMOUNT DISPENSING

CROSS-REFERENCE TO RELATED APPLICATION

This application claims the benefit of Korean Application No. 10-2012-0102571, filed on Sep. 17, 2012 with the Korean Intellectual Property Office, the disclosure of which is incorporated herein by reference.

TECHNICAL FIELD

This invention, relates to a spuit-type container cap for automatic filling and fixed-amount dispensing, and more particularly to a spuit-type container cap for automatic filling and fixed-amount dispensing, which has an improved structure of sucking and dispensing cosmetics accommodated in a spuit-type cosmetics container into the inside of a spuit pipe when the cosmetics are extracted in a spuit manner, so that a user can manipulate the spuit-type cosmetics container simply and conveniently.

BACKGROUND ART

High functional cosmetics such as essence, eye cream, antiaging and antiwrinkle agents and so on are expensive and small in the packing unit. Therefore, an existing cosmetics container accommodating the cosmetics is substantially compact in size and is simply constituted by a container body and a cover. In use, the cosmetics are got on hands through an outlet hole of the container and are applied on a skin. However, this has problems of difficulty in regulation of the amount of discharge of cosmetics and loss of the expensive cosmetics as much as the cosmetics are got on hands and are wasted.

For the purpose of overcoming these problems, a spuit-type cosmetics container which enables cosmetics to be extracted on a spuit basis and applied on a skin has been developed and spread.

As shown in FIG. 5, a conventional spuit-type cosmetics container 10 includes a container body 20 in which cosmetics are accommodated, and a spuit 30 which is provided to be inserted in the container body 20 and seal the container body 20.

The container body 20 has a male screw 21*a* formed on the outer circumference of an opening 21 and screw-coupled to the spuit 30. The spuit 30 includes a cap 31 having a female screw 31*a* formed to correspond to the male screw 21*a*, a spuit pipe 33 which is coupled to the cap and is introduced into the container body 20 through the opening 21, a push button 35 formed on the top of the cap 31, and an elastic member 37 such as a spring provided between the push button 35 and the cap 31.

However, this conventional spuit-type cosmetics container 10 has a problem of troublesome and inconvenient manipulation for use since a user has to couple the spuit 30 to the container body 20, push the push button 35 once, turn the spuit 30 to be separated from the container body 20, and push the push button 35 again.

In addition, since a certain user pushes the push button 35 before the spuit 30 is completely coupled to the container body 20 in order to quickly suck the cosmetics accommodated in the container body 20 into the spuit pipe 33, there is another problem of insufficient collection of cosmetics in the spuit pipe 33.

DISCLOSURE

Technical Problem

The present invention has been made to overcome the above problems and its object is to provide a spuit-type container cap for automatic filling and fixed-amount dispensing, which has an improved structure of sucking and dispensing cosmetics accommodated in a spuit-type cosmetics container into the inside of a spuit pipe when the cosmetics are extracted in a spuit manner, so that a user can manipulate the spuit-type cosmetics container simply and conveniently.

It is another object of the present invention to provide a spuit-type container cap for automatic filling and fixed-amount dispensing, which allows cosmetics accommodated in a container to be dispensed one drop by one drop under constant conditions irrespective of use habit of a user.

Technical Solution

To achieve the above objects, according to a first embodiment of the present invention, there is provided a spuit-type container cap for automatic filling and fixed-amount dispensing, comprising a container cap (50) which is compressed by being screw-coupled to a container (1) in which cosmetics are accommodated and an opening (1*a*) is formed in the upper side thereof, and then is filled with the content of the container (1) when the container cap (50) is decoupled from the container (1)

The container cap (50) may include: a first cylindrical member (51) which is a cylindrical member having opened upper and lower parts and is screw-coupled to the container (1) through the lower side thereof; a second cylindrical member (53) which is a cylindrical member having an opened upper surface and has, in the center of the lower surface thereof, a support (53*a*) that is protruded to the lower part such that a spuit pipe (52) accommodated in the container (1) can be inserted from the lower side, wherein the second cylindrical member (53) is provided with a pair of guide protrusions (53*b*) which are vertically formed on both sides of an outer surface thereof so as to vertically move by being inserted into a pair of guide grooves (51*a*) vertically formed on an inner surface of the first cylindrical member (51) when the container (1) is screw-coupled to the first cylindrical member (51); a cylindrical accordion member (54) having a lower inner surface in which a cylindrical protrusion (53*c*) protruded in a cylindrical form from the upper side of the lower surface of the second cylindrical member (53) is mounted; a circular plate-shaped member (55) which has a lower side protrusion (55*a*) mounted on an upper inner surface of the cylindrical accordion member (54), and of which a lower end of an outer surface thereof is placed on the upper side of the first cylindrical member (51); a rubber valve (56) which is inserted into a central hole (55*b*) of the circular plate-shaped member (55), and which is operated in order to introduce upper air through a plurality of slits (55*c*) radially formed on the outer side of the central hole (55*b*) and to prevent lower air from being discharged; a dome-shaped rubber button (57) which has a convex upper surface and has an air inlet hole (57*a*) in a central part thereof that is inserted into the outer side of the upper surface of the circular plate-shaped member (55); and a cylindrical cover member (58) which has a locking end (58*a*) on an inner surface of the upper part thereof such that a stopping end (58*a*) is locked in a step (57*b*) formed on the outer surface of the rubber button (57), and which simultaneously covers the outer surfaces of the circular plate-shaped member (55) and the first cylindrical member (51).

Advantageous Effects

According to the present invention, the spuit-type container cap for automatic filling and fixed-amount dispensing has advantageous effects that the content accommodated in the container is sucked into the spuit pipe when the container cap including the spuit is released from the screw-coupled state with the container and a fixed amount of the cosmetic content to be dispensed one drop by one drop when the upwardly protruded rubber button is pressed.

BEST MODE FOR INVENTION

A spuit-type container cap for automatic filling and fixed-amount dispensing according to a first embodiment of the present invention is characterized by a container cap 50 which is compressed by being screw-coupled to a container 1 in which cosmetics are accommodated and an opening 1*a* is formed in the upper side thereof, and then is filled with the content of the container 1 when the container cap 50 is decoupled from the container 1.

Mode for Invention

Hereinafter, preferred embodiments of the present invention will be described in detail with reference to the accompanying drawings. In the following detailed description of the present invention, concrete description on related functions or constructions will be omitted if it is deemed that the functions and/or constructions may unnecessarily obscure the gist of the present invention.

Embodiments

Figure 1:
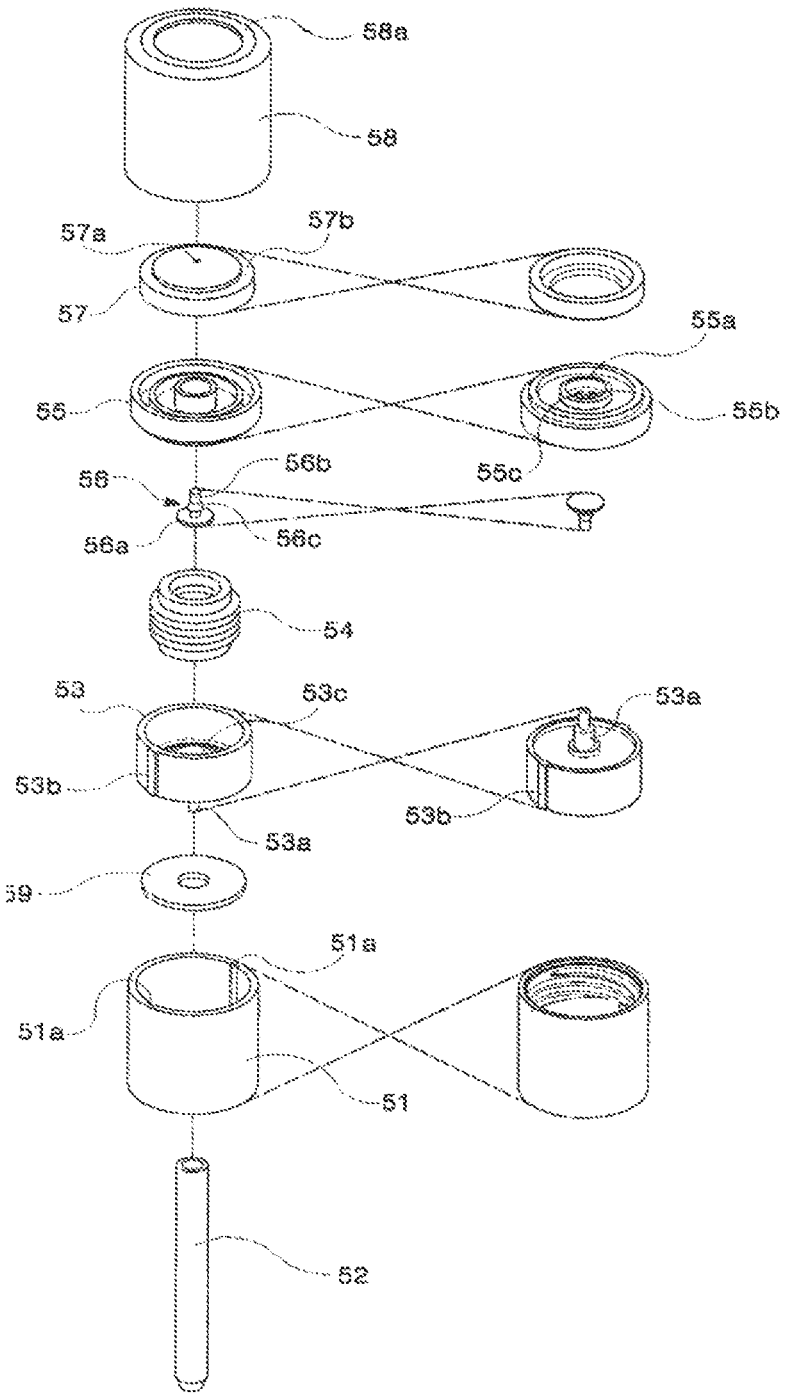
FIG. 1 is an exploded perspective view showing a spuit-type container cap for automatic filling and fixed-amount dispensing, according to the present invention.
Figure 2:
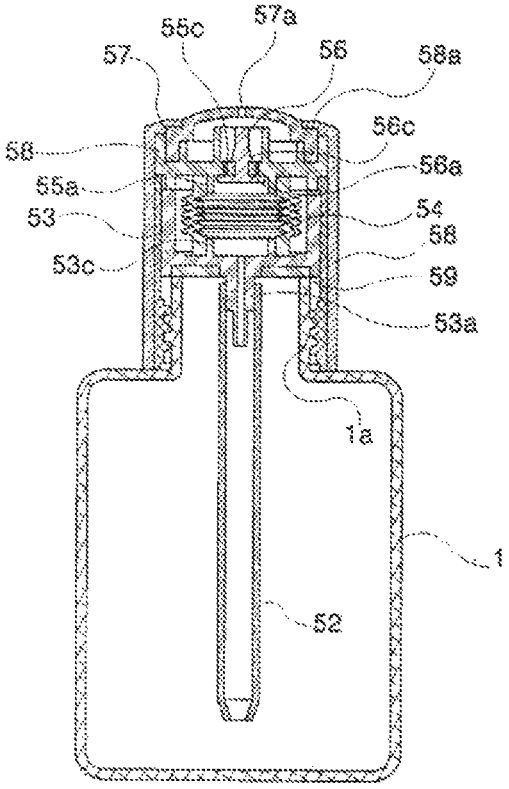
FIG. 2 is an assembly sectional view showing a state where an accordion member is compressed by coupling of the spuit-type container cap for automatic filling and fixed-amount dispensing to a container.
Figure 3:
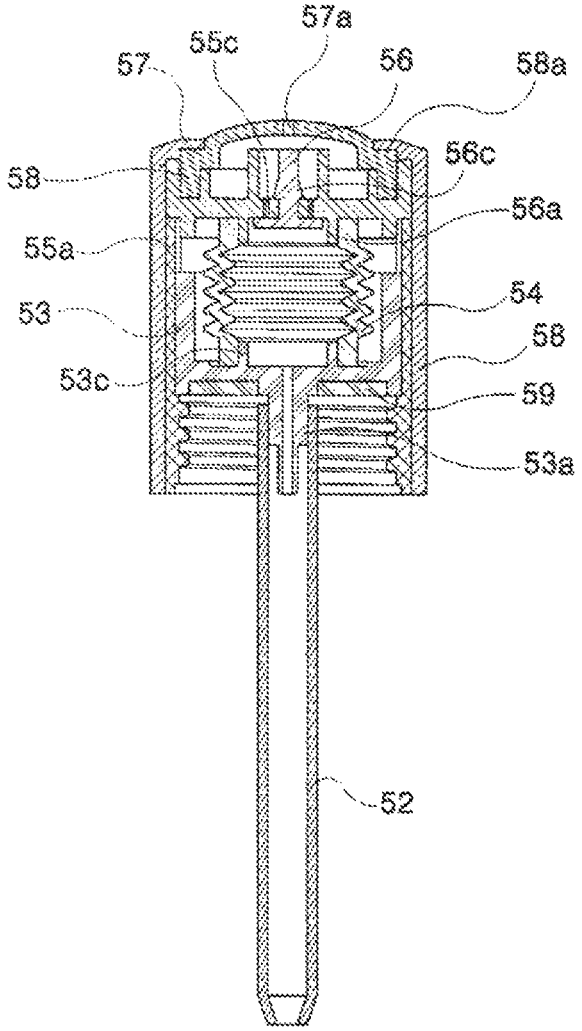
FIG. 3 is a sectional view showing a state where the spuit-type container cap for automatic filling and fixed-amount dispensing is decoupled from the container.
Figure 4:
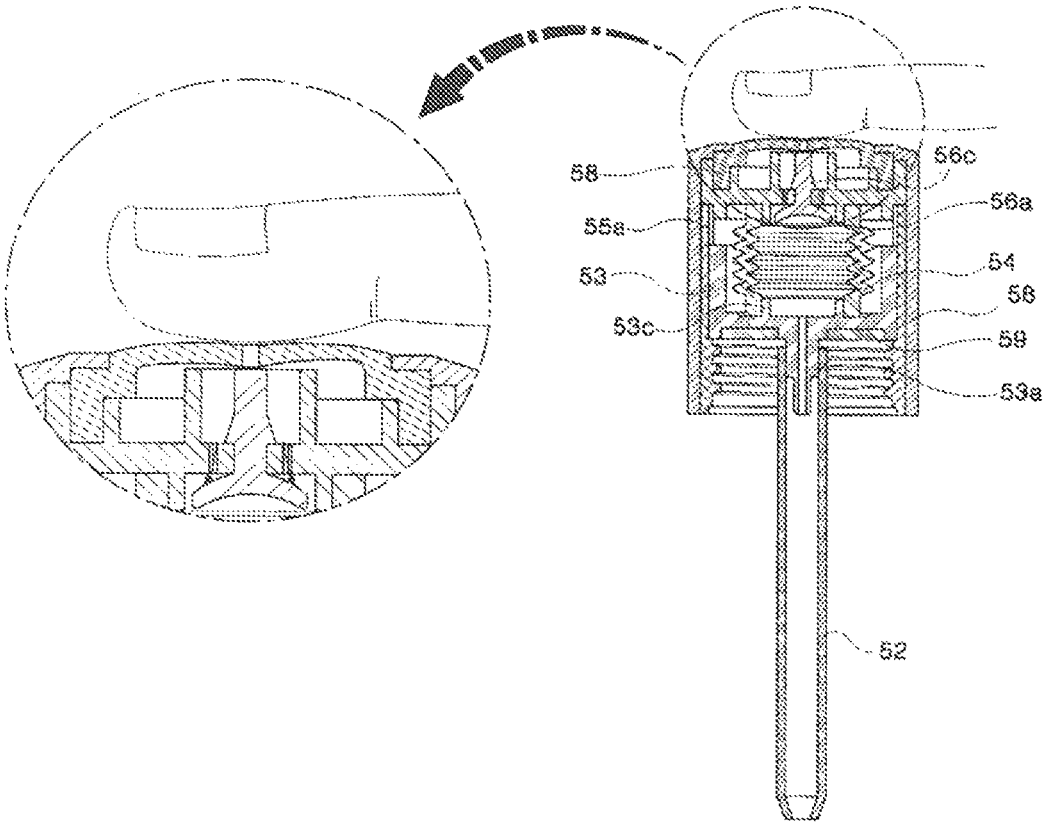
FIG. 4 is a sectional view showing a state where a button of the spuit-type container cap for automatic filling and fixed-amount dispensing is pressed.
Figure 5:
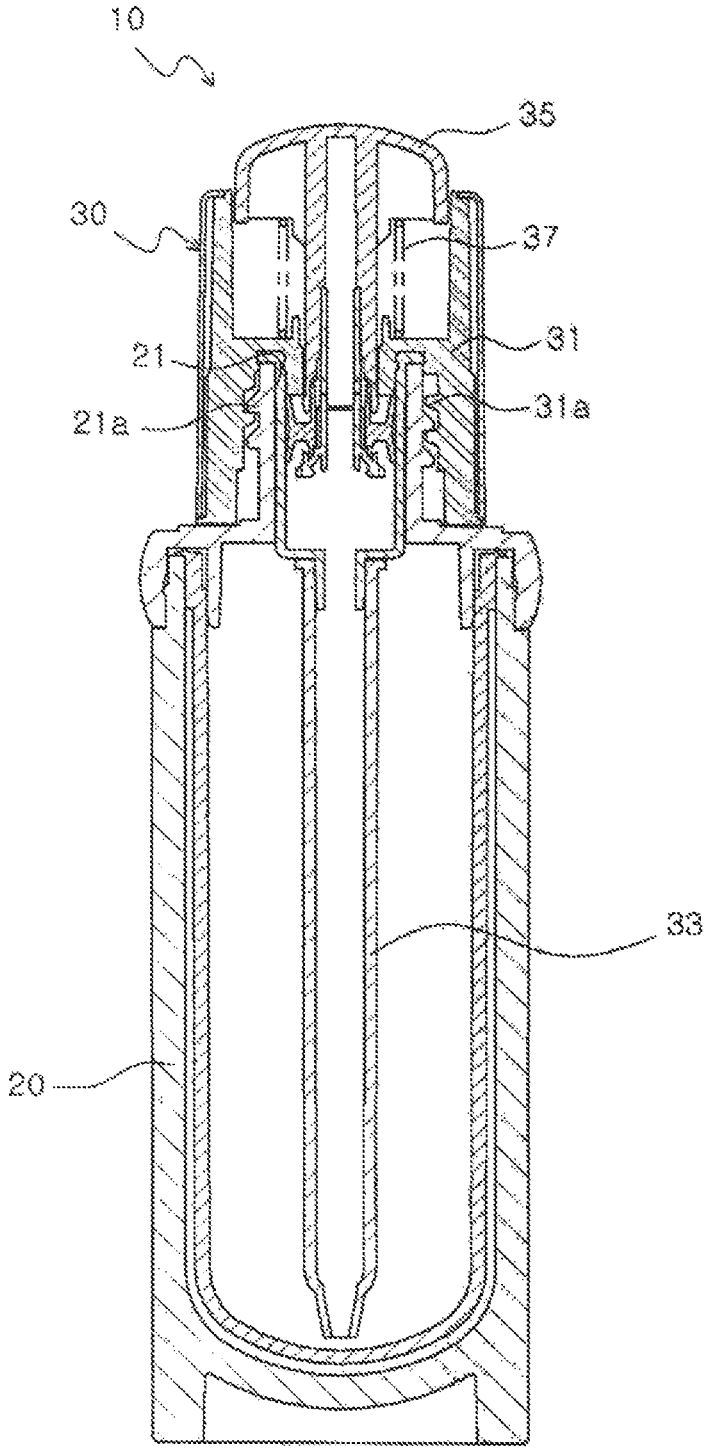
FIG. 5 is a sectional view showing a conventional spuit-type cosmetics container.

FIG. 1 is an exploded perspective view showing a spuit-type container cap for automatic filling and fixed-amount dispensing, according to the present invention, FIG. 2 is an assembly sectional view showing a state where an accordion member is compressed by coupling of the spuit-type container cap for automatic filling and fixed-amount dispensing to a container, FIG. 3 is a sectional view showing a state where the spuit-type container cap for automatic filling and fixed-amount dispensing is decoupled from the container, FIG. 4 is a sectional view showing a state where a button of the spuit-type container cap for automatic filling and fixed-amount dispensing is pressed, and FIG. 5 is a sectional view showing a conventional spuit-type cosmetics container.

As shown in FIGS. 1 to 4, the spuit-type container cap 50 for automatic filling and fixed-amount dispensing is coupled to the container 1 in which the cosmetics are accommodated and the opening 1*a* is formed in the upper side thereof.

The container cap 50 includes;

a first cylindrical member 51 which is a cylindrical member having opened upper and lower parts and is screw-coupled to the container 1 through the lower side thereof:

a second cylindrical member 53 which is a cylindrical member having an opened upper surface and has, in the center of the lower surface thereof, a support 53*a* that is protruded to the lower part such that a spuit pipe 52 accommodated in the container 1 can be inserted from the lower side, wherein the second cylindrical member 53 is provided with a pair of guide protrusions 53*b* which are vertically formed on both sides of an outer surface thereof so as to vertically move by being inserted into a pair of guide grooves 51*a* vertically formed on an inner surface of the first cylindrical member 51 when the container 1 is screw-coupled to the first cylindrical member 51;

a cylindrical accordion member 54 having a lower inner surface in which a cylindrical protrusion 53*c* protruded in a cylindrical form from the upper side of the lower surface of the second cylindrical member 53 is mounted;

a circular plate-shaped member 55 which has a lower side protrusion 55*a* mounted on an upper inner surface of the cylindrical accordion member 54, and of which a lower end of an outer surface thereof is placed on the upper side of the first cylindrical member 51;

a rubber valve 56 which is inserted into a central hole 55*b* of the circular plate-shaped member 55, and which is operated in order to introduce upper air through a plurality of slits 55*c* radially formed on the outer side of the central hole 55*b* and to prevent lower air from being discharged;

a dome-shaped rubber button 57 which has a convex upper surface and has an air inlet hole 57*a* in a central part thereof that is inserted into the outer side of the upper surface of the circular plate-shaped member 55; and a cylindrical cover member 58 which has a locking end 58*a* on an inner surface of the upper part thereof such that a stopping end 58*a* is locked in a step 57*b* formed on the outer surface of the rubber button 57, and which simultaneously covers the outer surfaces of the circular plate-shaped member 55 and the first cylindrical member 51.

A disc-like packing member 59 to seal a space between the container 1 and the container cap 50 is installed in the bottom of the second cylindrical member 53 and the support 53*a* is inserted in the center of the disc-like packing member 59.

The rubber valve 56 consists of a disc-like lower surface 56*a* which opens/closes the plurality of slits 55*c* in the bottom of the circular plate-shaped member 55, a pillar 56*b* protruded from the disc-like lower surface 56*a* to the center, and a tapered portion 56*c* in contact with the upper surface of the circular plate-shaped member 55 such that its diameter is increased downwardly from the outer surface of the pillar 56*b*.

Next, an operation of the above-configured spuit-type container cap for automatic filling and fixed-amount dispensing will be described. In order to spend the cosmetics in the spuit-type container cap 50, when the outer surface of the cylindrical cover member 58 is first turned with hands in the state as shown in FIG. 2, the contracted (compressed) cylindrical accordion member 54 is expanded while the container 1 screw-coupled to the first cylindrical member 51 is being decoupled from the first cylindrical member 51 (see FIG. 3). This expansion allows the content in the container 1 to be sucked into the second cylindrical member 53, i.e., the cylindrical accordion member 54, via the support 53*a* through the spuit pipe 52.

In order to use the content sucked into the spuit pipe 52 by the expansion of the cylindrical accordion member 54, as shown in FIG. 4, when the rubber button 57 is pressed while closing the air inlet hole 57*a*, the lower air of the rubber button 57 is compressed, guided a long the tapered portion 56*c* of the lower rubber valve 56, and discharged through the plurality of slits 55*c* of the circular plate-shaped member 55.

The air discharged through the plurality of slits 55*c* pushes out the disc-like lower surface 56*a* covering the lower surface thereof and is introduced into the cylindrical accordion member 54. The introduced air pushes out the content (cosmetics) in the cylindrical accordion member 54 by a certain amount such that the content in the spuit pipe 52 is dispensed by a certain amount.

When the pressed rubber button 57 is released, air is introduced through the air inlet hole 57*a* to return the disc-like lower surface 56*a* to the original position, thereby covering the plurality of slits 55*c*.

While the present invention has been particularly shown and described with reference to exemplary embodiments thereof, it will be understood by those skilled in the art that various changes in form and details may be made therein without departing from the spirit and scope of the present invention as defined by the appended claims and equivalents thereof.

What is claimed is:

1. A spuit-type container cap for automatic filling and fixed-amount dispensing, comprising a container cap (50) which is compressed by being screw-coupled to a container (1) in which cosmetics are accommodated and an opening (1*a*) is formed in the upper side thereof, and then is filled with the content of the container (1) when the container cap (50) is decoupled from the container (1)

wherein the container cap (50) includes:

a first cylindrical member (51) which is a cylindrical member having opened upper and lower parts and is screw-coupled to the container (1) through the lower side thereof;

a second cylindrical member (53) which is a cylindrical member having an opened upper surface and has, in the center of the lower surface thereof, a support (53*a*) that is protruded to the lower part such that a spuit pipe (52) accommodated in the container (1) can be inserted from the lower side, wherein the second cylindrical member (53) is provided with a pair of guide protrusions (53*b*) which are vertically formed on both sides of an outer surface thereof so as to vertically move by being inserted into a pair of guide grooves (51*a*) vertically formed on an inner surface of the first cylindrical member (51) when the container (1) is screw-coupled to the first cylindrical member (51);

a cylindrical accordion member (54) having a lower inner surface in which a cylindrical protrusion (53*c*) protruded in a cylindrical form from the upper side of the lower surface of the second cylindrical member (53) is mounted;

a circular plate-shaped member (55) which has a lower side protrusion (55*a*) mounted on an upper inner surface of the cylindrical accordion member (54), and of which a lower end of an outer surface thereof is placed on the upper side of the first cylindrical member (51);

a rubber valve (56) which is inserted into a central hole (55*b*) of the circular plate-shaped member (55), and which is operated in order to introduce upper air through a plurality of slits (55*c*) radially formed on the outer side of the central hole (55*b*) and to prevent lower air from being discharged;

a dome-shaped rubber button (57) which has a convex upper surface and has an air inlet hole (57*a*) in a central part thereof that is inserted into the outer side of the upper surface of the circular plate-shaped member (55); and a cylindrical cover member (58) which has a locking end (58*a*) on an inner surface of the upper part thereof such that a stopping end (58*a*) is locked in a step (57*b*) formed on the outer surface of the rubber button (57), and which simultaneously covers the outer surfaces of the circular plate-shaped member (55) and the first cylindrical member (51).

2. The spuit-type container cap according to claim 1, wherein a disc-like packing member (59) to seal a space between the container (1) and the container cap (50) is installed in the bottom of the second cylindrical member (53) and the support (53*a*) is inserted in the center of the disc-like packing member (59).

3. The spuit-type container cap according to claim 1, wherein the rubber valve (56) consists of a disc-like lower surface (56*a*) which opens/closes the plurality of slits (55*c*) in the bottom of the circular plate-shaped member (55), a pillar (56*b*) protruded from the disc-like lower surface (56*a*) to the center, and a tapered portion (56*c*) in contact with the upper surface of the circular plate-shaped member (55) such that its diameter is increased downwardly from the outer surface of the pillar (56*b*).

4. The spuit-type container cap according to claim 2, wherein the rubber valve (56) consists of a disc-like lower surface (56*a*) which opens/closes the plurality of slits (55*c*) in the bottom of the circular plate-shaped member (55), a pillar (56*b*) protruded from the disc-like lower surface (56*a*) to the center, and a tapered portion (56*c*) in contact with the upper surface of the circular plate-shaped member (55) such that its diameter is increased downwardly from the outer surface of the pillar (56*b*).

* * * * *